US007353564B2

(12) United States Patent
Wertz

(10) Patent No.: US 7,353,564 B2
(45) Date of Patent: Apr. 8, 2008

(54) VACUUM SWEEPER

(76) Inventor: Robert Wertz, 545 S. 300 West, Salt Lake City, UT (US) 84101

( * ) Notice: Subject to any disclaimer, the term of this patent is extended or adjusted under 35 U.S.C. 154(b) by 675 days.

(21) Appl. No.: 10/770,228

(22) Filed: Feb. 3, 2004

(65) Prior Publication Data

US 2005/0166359 A1 Aug. 4, 2005

(51) Int. Cl.
*A47L 5/36* (2006.01)

(52) U.S. Cl. ..... 15/410; 15/327.5; 15/414; 15/415.1

(58) Field of Classification Search ..... 15/1.7, 15/327.5, 393, 398, 400, 401, 414, 415.1, 15/410, 411; 285/7; *A47L 5/36*
See application file for complete search history.

(56) References Cited

U.S. PATENT DOCUMENTS 3,306,634 A * 2/1967 Groves et al. ..... 285/7
5,113,547 A * 5/1992 Mayhew ..... 15/322
6,065,183 A * 5/2000 Hammeken et al. ..... 15/411
6,073,301 A * 6/2000 Berfield ..... 15/327.5
2005/0066471 A1* 3/2005 Miller et al. ..... 15/401

FOREIGN PATENT DOCUMENTS

JP 10258005 A * 9/1998
JP 2001095733 A * 4/2001

* cited by examiner

*Primary Examiner*—Theresa T Snider

(57) ABSTRACT

An attachment for portable power and suction units, including a long control tube having a length to extend from a floor to adjacent shoulder height of a standing user and a vacuum head formed from a length of tube having a slot in one side and with the ends of the slot closed; and a flexible connection between the interior of the vacuum head and the interior of a control tube to be connected to a portable power and suction unit while allowing limited pivoting of the long control tube in the plane of the slot and normal to a bottom of the vacuum head.

5 Claims, 4 Drawing Sheets

VACUUM SWEEPER

CROSS-REFERENCE TO RELATED APPLICATIONS

Not Applicable.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This invention relates to vacuum cleaners and particularly to the hose and nozzle structures for such vacuum cleaners.

2. Description of the Related Art

There have been a great many portable vacuum cleaners developed in the past for use in the care and cleaning of floor materials. Many of the portable vacuum cleaners developed in the past have been intended for use in picking up dirt and debris from carpets and other floor coverings and even from wooden floors.

In the use of portable vacuum cleaners, particularly for commercial purposes, i.e., in public buildings, such as hotels, office buildings and other such structures, it becomes very necessary that the floor cleaning operations be made as simple as possible so that the floor cleaning can be performed in a minimum amount of time. Time is money.

In the past, portable vacuum cleaners have been made to stand upright, to be pulled along the floor, or to be back-packed.

The upright vacuum cleaner is very popular and generally includes a head carried on wheels and with a power and suction producing apparatus all made as an integral part of a wheeled head. The head has a bottom opening through which dirt and debris from a floor is pulled and the dirt and debris is moved into a bag or collection chamber for future removal and disposal. In use, a handle on the vacuum is grasped and the entire vacuum cleaner is moved back and forth on the wheels. In making such movements, the operator necessarily bends back and forth at his waist. The repeated bending and standing motion is often damaging to the back of the user. Frequently, the upright vacuum cleaners also include a flexible hose attachment with a collection nozzle or an extension tube on one end and the other end being attached to the power and suction unit. The user then generally grasps the nozzle or the extension tube to move it over areas requiring vacuum cleaning. The entire weight of the vacuum cleaner must be moved during a cleaning operation, the weight being moved contributes to injury to the back of the user.

Vacuums having wheels supporting power and suction systems and long hoses that are connected to the wheel system so that as a nozzle on the end of the hose is maneuvered the wheel system will follow along. These pull along type systems may use or frequently use extension tubes that will have a vacuum head on one end of the hose and the other end of the tube connected to the flexible hose and with the extension tube being generally extensible to about the length of the distance from floor to waist of the user.

The known back-packed type vacuum cleaners generally have a power and suction collection system mounted to be carried by straps on the back of a user. A flexible hose normally extends over a shoulder of the user and down to a telescopic wand of the same type commonly used with the upright and pull-along type vacuum cleaners. The tube used generally extends only from the floor to the waist of the user. A vacuum head is on one end of the telescoping tube and the other end is connected to the flexible hose.

With all of the prior art vacuum cleaners disclosed above, it is common that the telescoping tube be adjustable so that the tube can have a full length extending from floor to proximate the waist of a user or can be shortened to provide for hand use by grasping of the shortened tube to manipulate the vacuum head.

The vacuum head of the vacuum cleaners disclosed above, is generally quite large, generally includes wheels to facilitate movement over a floor and may include different types of floor engaging surfaces at the sides of an intake slot. With all of the prior art vacuums, the vacuuming action comprises pushing or pulling the upright or in moving the extension tube in a push-pull action that is consistent with the rolling action of the wheels of the intake head. When a telescopic tube is used and is hand grasped adjacent the vacuum head, the head may be moved in a variety of directions and becomes useful with tools that do not have wheels and that can be moved forward, backward, sideways, or virtually in any pattern the user desires. However, when using the shortened telescopic tube in the manner described, it is slow and tedious to do a large floor since a person must be on hands and knees in order to properly maneuver the vacuum head and to pull the power and suction unit along behind. Commonly, the shortened telescopic tube and vacuum head attached thereto are used primarily for cleaning furniture, drapery or other objects that are normally positioned above floor level.

The same type vacuum head that is used commonly attached to a shortened telescopic tube or directly to the flexible hose is also commonly used by pushing and pulling with respect to the user. The pushing and pulling pattern is necessary to assure that the opening in the vacuum head will pass over a maximum area being vacuumed and, as previously noted may cause significant injury to the back of a user.

OBJECTS OF THE INVENTION

Principal objects of the present invention are to provide a vacuum sweeper that allows a user to remain in an upright standing position while vacuuming. The user may use the vacuum sweeper in a push-pull motion, the same as other known vacuum cleaners, or may move the head of the vacuum in a sweeping motion back and forth in front of the user's body. Whether used in a push-pull pattern, or a sweeping pattern, the light weight vacuum sweeper of the invention is less damaging to the back of a user than are the prior art vacuum systems.

When using the vacuum sweeper of the invention, a standing user can easily vacuum closely adjacent to furniture, cabinets and walls, and can readily vacuum between structures and even below raised furniture structures.

While particularly adaptable as a back-packed unit, the vacuum sweeper of the invention can be a pull-around vacuum unit. In any event, with the vacuum sweeper of the invention, a standing user can sweep an area much faster and more effectively than can be achieved with the other push-pull only type vacuum systems and without bending at the waist.

Additional objects and features of the invention will become apparent from the following detailed description of a preferred embodiment of the invention and the claims.

FEATURES OF THE INVENTION

Principal features of the invention include a long tube extending from ground level to adjacent shoulder level of a standing user, a flexible tube connecting an upper end of the long tube to a power and suction unit, which may be a back-packed power and suction system or a pull-around power and suction system. The back-packed vacuum system and/or the pull-around vacuum system may be conventional and the system used will be connected through a flexible hose to the upper end of the long tube.

A lower end of the long tube has a vacuum head connected thereto through an articulated connection. The articulated connection allows the vacuum head to pivot with respect with a plane through the elongate axis of the long tube and the articulated connection allows the vacuum head to be positioned so that the long tube can rotate to be used in performing either a push-pull type movement or a sweeping movement.

Different types of floor engaging surfaces may be provided at opposite sides of a pickup slot in the vacuum head.

Preferably, both the long tube and the vacuum head of the invention are formed from a material that is durable and inexpensive. The vacuum head is preferably made of a material that will pass easily and smoothly over different types of floor materials, i.e., wood, linoleum, tile and carpet. The vacuum head is also preferably made to receive selected ground engaging surface members that are particularly useful in vacuuming material from different floor materials.

DETAILED DESCRIPTION

Referring now the Drawings

Figure 1:
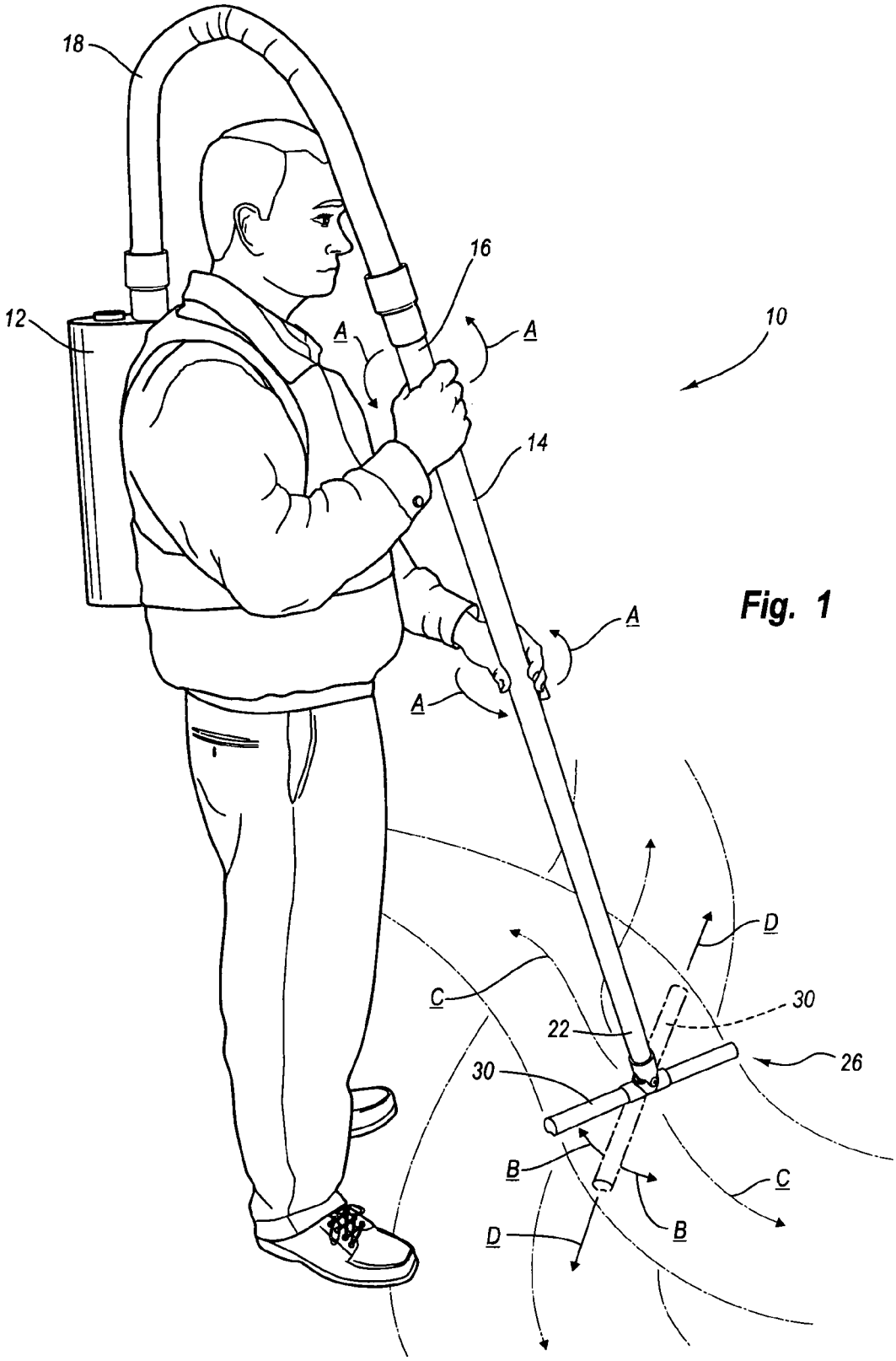
FIG. 1 is a pictorial view of a standing man using the vacuum sweeper of the invention.
Figure 2:
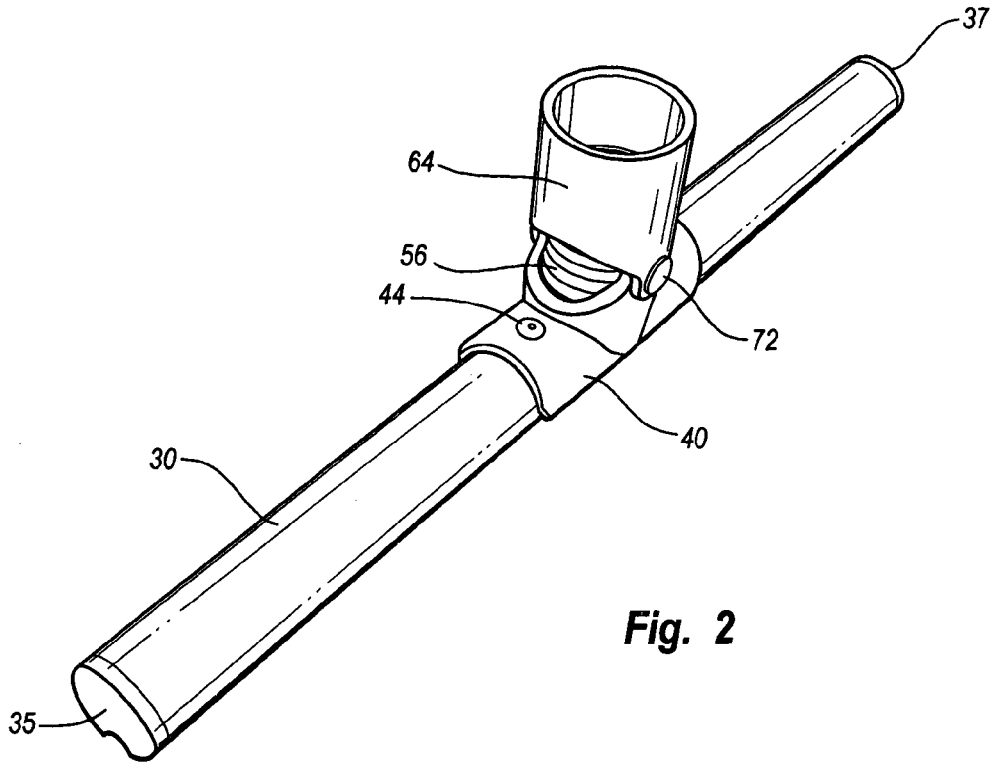
FIG. 2, a perspective view of the vacuum head of the vacuum sweeper of the invention.
Figure 3:
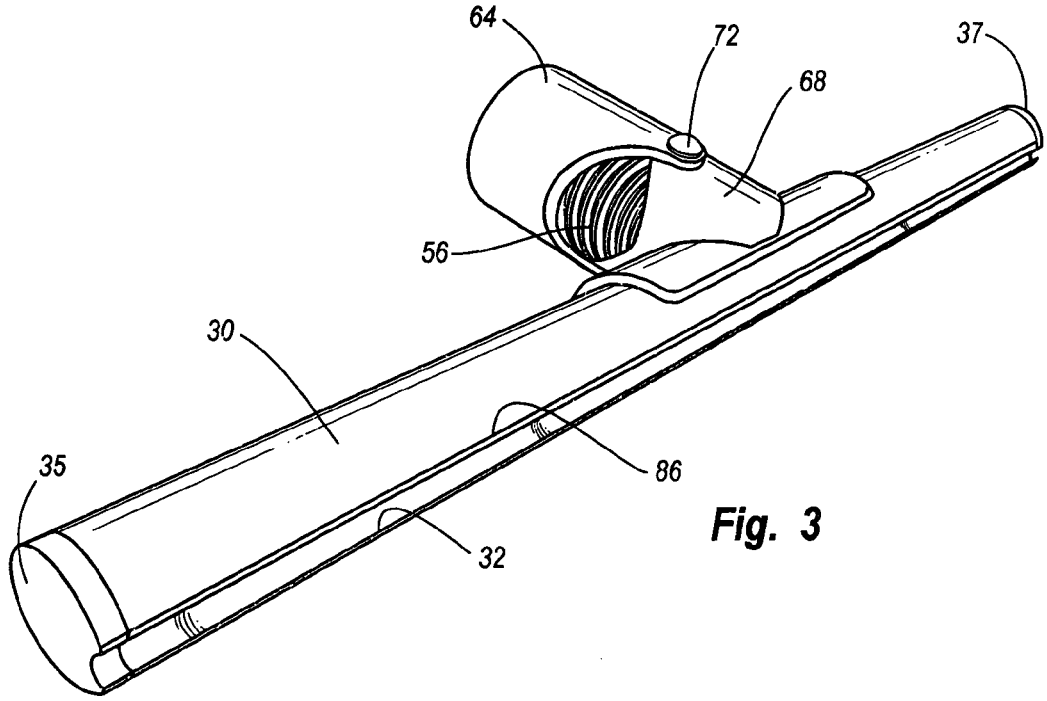
FIG. 3, a perspective view of the head of FIG. 2, shown rotated for viewing of the pick-up slot of the vacuum head.

The vacuum sweeper 10 of the invention includes a power and suction unit 12, a long control tube 14, having an upper end 16 to which a flexible hose 18 is connected between the long control tube 14 and the power and suction unit 12. A lower end 22 of the long control tube 14 is connected to a vacuum head 26.

Vacuum head 26 includes a elongate tubular, ground engaging member 30, having a slot 32 formed in a bottom surface of the vacuum head.

End plates 35 and 37 are respectively provided at opposite ends of the vacuum head and a central hole 36 is provided through a top surface 38 of the vacuum head 26.

A saddle member 40 fits over the hole 36 and is adhesively bonded, and/or is riveted with rivets 44 and 46 to the vacuum head 26.

Saddle member 40 has a collar 48 adhesively bonded, or otherwise affixed thereto. Collar 48 surrounds the hole 36 and has ears 50 and 52, respectively projecting upwardly from opposite sides of the vacuum head 26.

A flexible sleeve 56 extends downwardly into the collar 48 and projects upwardly from the collar 48.

The long control tube 14 has a connector member 64 with downwardly extending ears 66 and 68 at opposite sides thereof.

Figure 4:
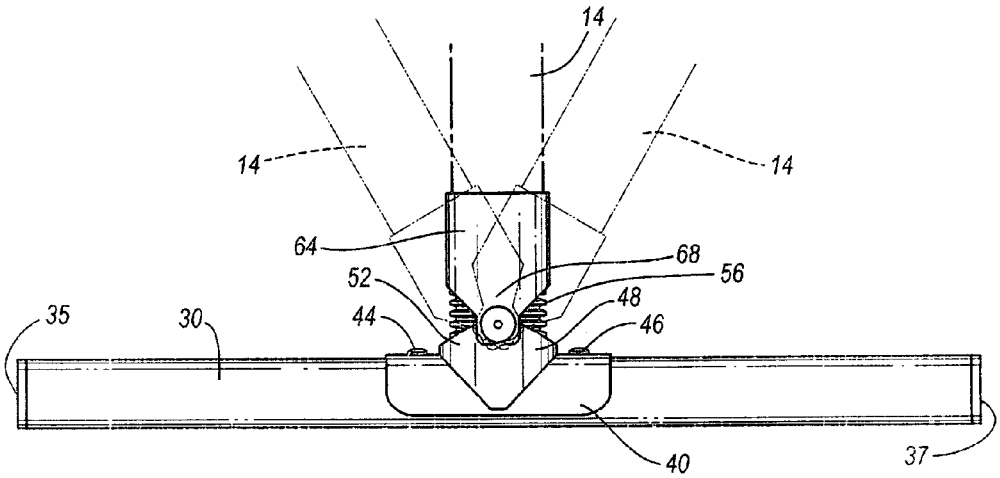
FIG. 4, a front elevation view of the vacuum head shown attached to a long tube, shown fragmentarily, and showing pivoted positions of the vacuum head during a vacuuming procedure.
Figure 5:
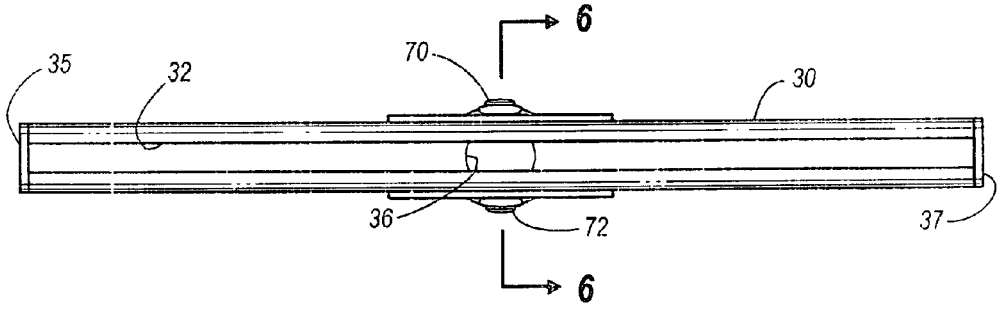
FIG. 5, a bottom plan view of the vacuum head as shown in FIG. 4.
Figure 6:
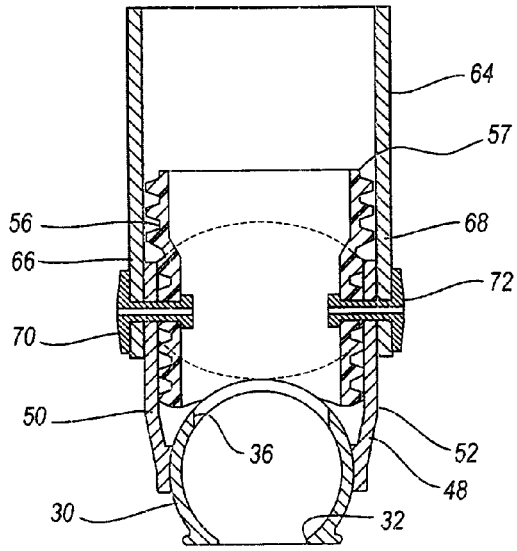
FIG. 6, an enlarged vertical section taken on the line 6-6 of FIG. 5.

The lower end 22 of control tube 14 telescopes over an upper end 57 of flexible sleeve 56 and ears 66 and 68, respectively, extend downwardly to align with ears 50 and 52 of collar 48. A rivet 70 extends through ears 66 and 50 to serve as a pivot connection. Another rivet 72 extends through the ears 68 and 52 to serve as a pivot connection. As control tube 14 is pivoted (FIG. 4) about the pivot connections 70 and 72 in a plane extending through the length of tube 50, relative to the vacuum head 26, the flexible sleeve 56 bends and maintains a flow passage between the vacuum head and the interior of long control tube 14. Pivoting of the control tube 14 relative the vacuum head 26 is stopped by engagement of connector member 64 with collar 48.

The long control tube 14, connector member 64, collar 48 and vacuum head 26 are substantially rigid and may be made using polyvinyl chloride tubing, for example.

In using the vacuum sweeper 10 shown, the power and suction unit is strapped on the back of a user and the flexible hose 18 has one end connected to the power and suction unit 12. The other end of the flexible hose is connected to the long control tube 14 at or near the shoulder of the user. It will be apparent that the flexible hose 18 could alternatively be connected to a roller mounted, or skid mounted, power and suction unit (not shown) or to any other suitable power and suction unit.

The user grasps the long control tube 14 with the vacuum head on a floor surface in front of the user and the slot 32 extending across the floor surface. In cleaning large areas the user can use a side-to-side or a curved pattern of the vacuum head. When performing these motions, the user turns the long control tube 14 about its axis, as shown by arrows A, to position the vacuum head 26 for the desired cleaning pattern. Then, the user sweeps the vacuum head back and forth (arrows B) or in arcuate patterns (arrows C) as he moves forward or backward across the area to be vacuumed. Dirt and debris is moved through slot 32 and the long tube to the power and suction unit in the manner common to other vacuums. The pivot action provided by pivot connections 70 and 72 allows the vacuum head to remain flat on the floor as the sweeping action occurs.

The vacuum head has a low profile and by turning the long control tube about its axis as shown by arrows A, the vacuum head can be positioned to move closely against wall surfaces and furniture and to have an end move as shown by arrows D, into corners along right angle surfaces and under furniture and the like.

During use of the vacuum sweeper 10, the user can stand fully upright and does not need to bend at the waist, as is common during use of commonly known vacuum cleaners.

It has been found that the use in the upright position greatly reduces strain on the back of the user. The back strain is also reduced since the user only moves the long control tube and light weight vacuum head during sweeping. It has also been found that sweeping with the vacuum head 26 results in faster cleaning of large areas of floor covering than can obtained using known vacuum cleaners having push-pull heads. This is also particularly important during commercial cleaning where fast, effective vacuuming is required.

While the vacuum head 26, formed from a PVC tube 30, or the like and having the slot 32 on the ground engaging surface provides an effective vacuum head, attachments can be used with the vacuum head 26, if desired. Also, while other means can be used to secure attachments in place, it has been found that upturned edges 86 and 88 extending the length of slot 32, can be readily used for the purpose.

Figure 7:
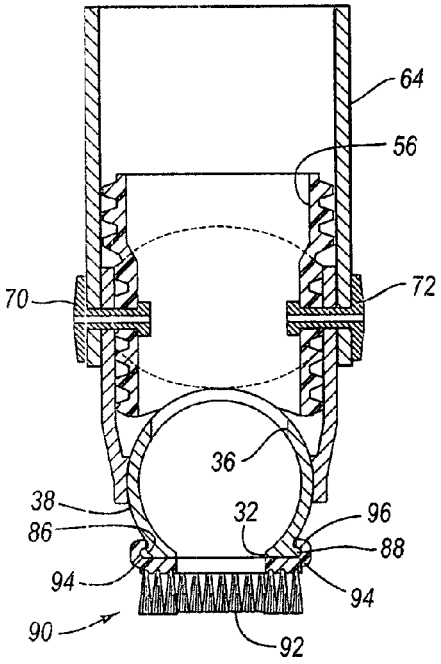
FIG. 7, a view like that of FIG. 6, but showing a brush type surface engagement attachment on the vacuum head.
Figure 9:
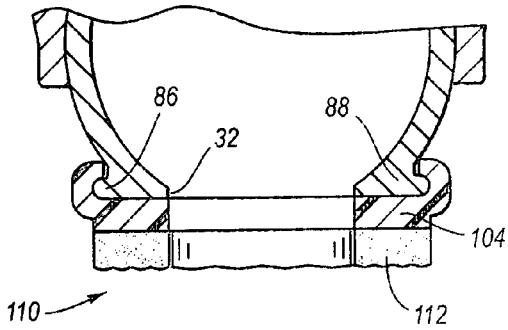
FIG. 9, a view like that of FIG. 7, but showing still another type of surface engagement attachment secured to the vacuum head.
Figure 8:
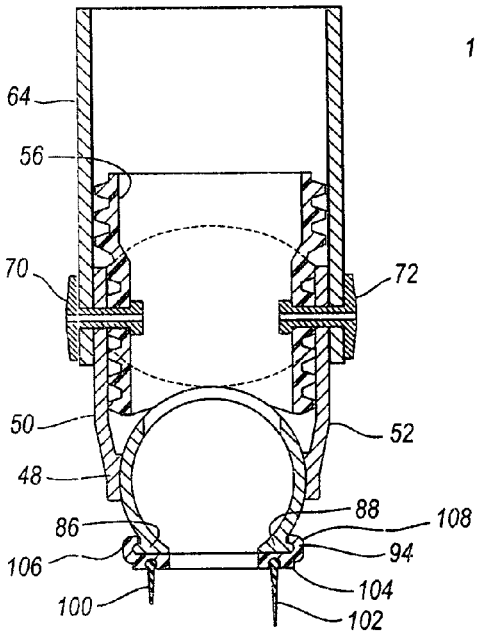
FIG. 8, a view like that of FIG. 7, but showing a squeegee type attachment on the vacuum head.

As shown in FIGS. 7-9, various kinds of cleaning attachments can be secured to the vacuum head 26.

As shown in FIG. 7, a brush type attachment 90 has bristles 92 projecting downwardly from a flange 94 that surrounds slot 32. Down turned edges 96 of the flange 94 slide into the upturned edges 86 and 88 to secure the brush attachment 90 in place.

As shown in FIG. 8, squeegee blades 100 and 102 are attached to opposite sides of a frame 104 that is attached to the vacuum head by down turned edges 106 and 108 that are hooked into the upturned edges 86 and 88 of the vacuum head. The squeegee attachment is particularly useful when the power and suction unit of the vacuum sweeper 10 is of the wet type, capable of picking up liquids.

The attachment 110 of FIG. 9 includes a soft pad surface 112 surrounding the opening through the frame 104 attached to the vacuum head.

It will be apparent that other types of attachments can also be used.

Although preferred forms of my invention have been herein disclosed, it is to be understood that the present disclosure is by way of example and that variations are possible without departing from the subject matter coming within the scope of the following claims, which subject matter I regard as my invention.

I claim:

1. A vacuum sweeper comprising a portable power and suction unit;

a long rigid control tube that extends from floor to an adjacent shoulder height of a user;

a flexible tube connecting an upper end of said control tube to said power and suction unit;

a tube forming a vacuum head connected to a lower end of said control tube;

means connecting the interior of said vacuum head to the interior of said control tube and an elongate slot formed in a bottom of said tube forming said vacuum head;

means at opposite ends of said slot to close the ends of said slot;

means pivotally connecting the tube forming the vacuum head to the long control tube to provide pivoting of the long control tube substantially in a plane extending through the elongate slot and normal to the bottom of the vacuum head and including means to prevent pivoting of said long control tube relative to said vacuum head other than in said plane through said slot.

2. The vacuum sweeper as in claim 1, wherein the means pivotally connecting the tube forming the vacuum head to the long control tube comprises a first pair of spaced apart ears extending upwardly from opposite sides of the tube forming the vacuum head;

a second pair of spaced apart ears extending downwardly from the end of the long control tube to align with the first pair of ears;

a first pivot pin extending through one ear of said first pair of ears and one ear of said second pair of ears; and a second pivot pin extending through the other ear of said first pair of ears and the other ear of said second pair of ears.

3. The vacuum sweeper as in claim 2, further including means to limit pivoting of the control tube relative to the vacuum head in the plane extending through the elongate slot and normal to the bottom of the vacuum head.

4. The vacuum sweeper as in claim 1, wherein the portable power and suction unit includes straps for attachment to the back of a user.

5. The vacuum sweeper as in claim 1, wherein the means connecting the interior of the vacuum head to the interior of the control tube includes a flexible sleeve means pivotally connecting said vacuum head to said long control tube.

* * * * *